United States Patent [19]

Knabusch et al.

[11] 4,082,355

[45] Apr. 4, 1978

[54] LOCKABLE BACK ON A SOFA BED

[75] Inventors: Edward M. Knabusch; Edwin J. Shoemaker, both of Monroe, Mich.

[73] Assignee: La-Z-Boy Chair Company, Monroe, Mich.

[21] Appl. No.: 776,501

[22] Filed: Mar. 11, 1977

[51] Int. Cl.[2] ..... A47C 4/02

[52] U.S. Cl. ..... 297/440; 297/443

[58] Field of Search ..... 297/440, 443, 444; 248/224.3, 207, 223.4, 224.1, 224.2; 108/57.1; 5/300

[56] References Cited

U.S. PATENT DOCUMENTS

| | | | |
|---|---|---|---|
| 558,830 | 4/1896 | McCume | 297/444 |
| 609,703 | 8/1898 | Richardson | 5/300 X |
| 1,356,745 | 10/1920 | Schwartz et al. | 248/224.1 |
| 1,695,101 | 12/1928 | Hoffman | 297/283 |
| 2,575,221 | 11/1951 | Horner | 297/443 |
| 2,602,619 | 7/1952 | McIntyre | 108/57.1 |
| 3,525,549 | 8/1970 | Knabusch et al. | 297/440 X |

*Primary Examiner*—Francis K. Zugel

*Attorney, Agent, or Firm*—Harness, Dickey & Pierce

[57] ABSTRACT

An upholstered sofa frame for a convertible bed has separable back and seating units which are independently upholstered. The back has a slide bracket at each end facing the rear portion of the inner surface of the arm against which a mounting bracket is secured. The slide bracket has a locking lever pivoted thereto containing a cam face which is moved toward a notch in the mounting brackets for locking the back to each of the arms. The back unit when constructed without wings may be laid upon the seat for compact shipment. It may be removed when the unit is passed through a narrow door of less height than the length of the back so that the unit may have the two pieces moved separately through the door and assembled. It may be removed when the stored bed unit is partially removed from the storage area to permit cleaning thereunder without requiring the entire unit to be moved to some other part of the room.

2 Claims, 6 Drawing Figures

LOCKABLE BACK ON A SOFA BED

BACKGROUND OF THE INVENTION

Reference may be had to U.S. Pat. No. 3,525,549 which was assigned to the assignee of the present invention and to the art which was cited therein for disclosures of slide and mounting brackets which may be locked together in somewhat the manner of the present invention.

SUMMARY OF THE INVENTION

A sofa frame is usually heavy as it must support a plurality of bed sections which are pivoted together to permit them to be rolled outwardly into planar relation when forming a bed and which roll up to form a compact unit which may be stored within the bottom and back of the sofa frame. While a chair may be tilted to have the back first moved through a door followed by the rest of the chair, a sofa frame may be too wide for the door height and such a maneuver could not occur. This difficulty can be overcome by having the back unit removed so that it and the seat unit may separably be moved through the door. If the back is of such form that it can be placed upon the seating unit between the arms, then the unit can be compactly assembled for shipment or storage. The removal of the back also permits the cleaning under the stored bed unit without moving the unit in another part of the room.

The arms have mounting brackets secured thereto which are made of two like pieces having aligned spherical extending portions which are welded, riveted or otherwise secured together and screwed or otherwise attached to the arms in vertical position. The slide brackets have facing channels at side edges which receive the edge of the outermost element of the mounting bracket when moved downwardly thereover. The slide brackets are mounted on the facing portion at the ends of the back unit to which they are secured by a plurality of screws. The slide bracket has a cam lever pivoted thereto which when operated moves the cam portion within a notch on the engaged part of the mounted bracket.

DESCRIPTION OF THE PREFERRED EMBODIMENT

Figure 1:
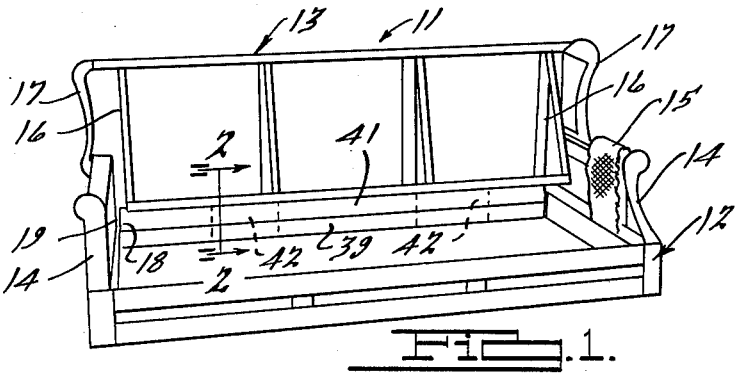
FIG. 1 is a perspective view of a sofa frame embodying features of the present invention.
Figure 2:
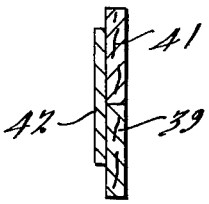
FIG. 2 is an enlarged sectional view of the structure illustrated in FIG. 1, taken on line 2—2 thereof.

A sofa 11 is illustrated in FIG. 1 as embodying a base frame 12 and a separate back frame 13. An arm 14 is provided at each end of the base frame 12, the arm on the righthand side of the frame has upholstering material 15 thereon. The upholstering material 15 is provided over the entire back frame and also on the seat frame, the two frames being separately upholstered so that the back frame can be removed from the base frame. The ends 16 of the back frame are extended to form the decorative arm portions 17 with the area of the bottom portion 18 of the ends 16 facing an area 19 at the rear portion of the arms. A slide bracket 21 is secured to each of the areas 18 at the bottom of the ends in position to engage a supporting bracket 22 on the facing area 19 at the rear of the arms 14. When the slide brackets 21 on the ends of the back frame 13 engage the supporting brackets 22 on the arms, the back frame is supported in fixed relation to the base frame.

Figure 3:
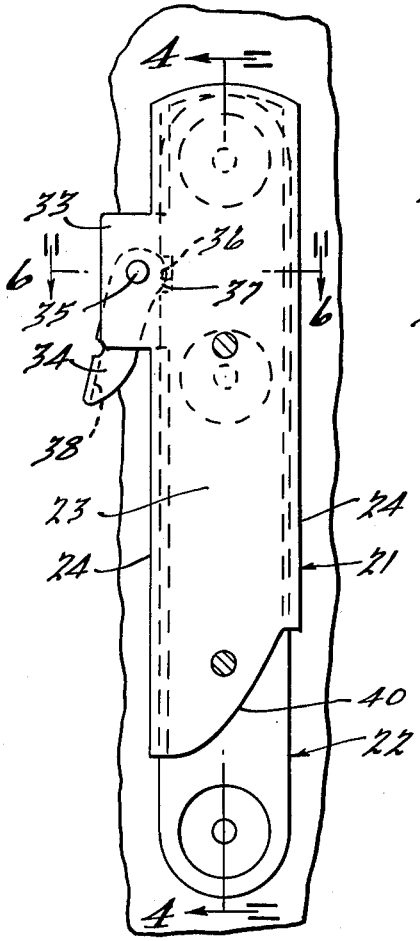
FIG. 3 is a plan view of a joined slide and mounting bracket embodying features of the present invention.
Figure 4:
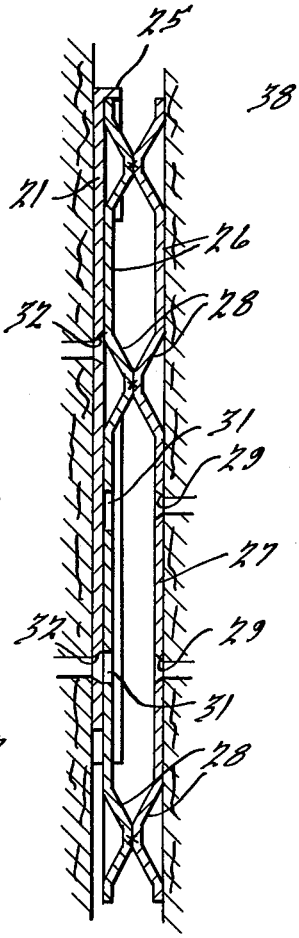
FIG. 4 is a sectional view of the structure illustrated in FIG. 3, taken on the line 4—4 thereof.
Figure 5:
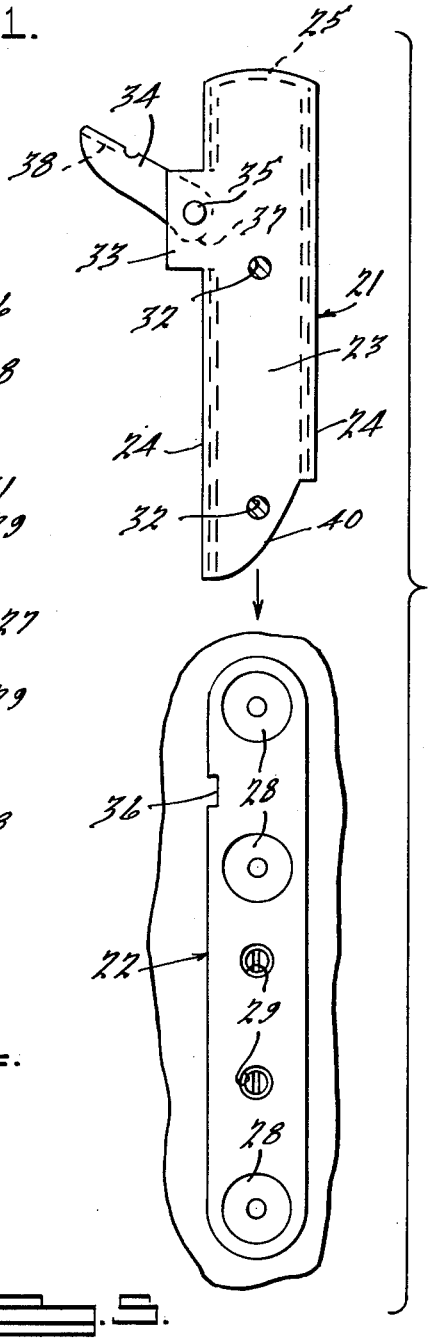
FIG. 5 is a reduced view of the structure illustrated in FIGS. 3 and 4 with the slide bracket shown above the mounting bracket in separated relation.
Figure 6:
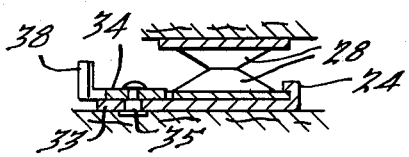
FIG. 6 is a sectional view of the structure illustrated in FIG. 3, taken on the line 6—6 thereof.

As illustrated in FIGS. 3, 4 and 5, the slide bracket 21 has a web 23 with the side edges reversely bent at 24 to form facing channels which engage the supporting bracket 22 when slid downwardly thereover. The top of the web 23 of the slide bracket is bent at an angle to provide a flange 25 which limits the downward movement of the slide bracket relative to the supporting bracket.

The supporting bracket 22 is made of two like parts 26 having elongated strips 27 containing pressed-out conical portions 28 herein illustrated as three in number. The apexes of the conical portions 28 are secured together by being riveted or welded with the strips 27 in spaced relation. The strip 27 on the right, as viewed in FIG. 4, has a pair of openings 29 for receiving screws which secures the strip to the facing area of the arms 14 when set by a tool which passes through aligned apertures 31 in the lefthand strip of the bracket. Apertures 32 are provided in the slide bracket 21 for screws which secures the bracket to the facing area at the ends of the back frame.

The slide bracket 21 has the channel element 24 on the lefthand edge, as illustrated in FIG. 3, formed into a flange 33 in the plane of the strip 23. A cam lever 34 is secured to flange 33 by a pivot 35. The lefthand web 27 of the supporting bracket 22 has a notch 36 in which a cam head 37 of the lever 34 enters and locks the slide bracket to the supporting bracket. The head is aligned with the notch by the flange 25 at the top of the slide bracket. It will be noted that the slide bracket 21 is cut off at the bottom to provide a sloping edge 40 to assist in aligning the slide bracket with the supporting bracket. It is to be understood that the base frame 12 and the back frame 13 are separately upholstered and that the cam lever 34 will be disposed between the upholstering material and to be operated by a screw driver or other implement which will engage an angularly presenting flange 38 on the end of the lever 34.

It will be noted that at the back of the base frame there is a board or runner 39 which is aligned with a board or runner 41 on the bottom rear portion of the back frame. Plates 42 are herein illustrated as being secured to the back frame board 41 to extend downwardly into engagement with the rear face of the base frame board 39. While plates 42 are mentioned, it is to be understood that a channel member could be provided on the bottom of the board 41 of the back frame which could extend over the board 39 of the bottom frame so that neither board could warp or move out of alignment. The channel member could be extended to cover most of the length of the board.

What is claimed is:

1. In an upholstered sofa, an upholstered base frame, an upholstered back frame, said frames being separately upholstered, separable hardware on facing areas at the rear of the base frame and near the bottom of said back frame at both ends of the sofa, said separable hardware embodying a pair of slide brackets and a pair of support brackets, one support bracket secured on each end of the facing areas of the base frame, each slide bracket has the side edges reversely bent to form facing channels, said support brackets being made of two elongated strips, each having a pair of spaced conical portions at one end and a single conical portion spaced therefrom at the other end, said conical portions being joined at the smaller ends to provide a rear strip securable to the facing areas near the bottom ends of the back frame with the front strip forming slides at the side edges which extend into the facing channels of the slide bracket when moved downwardly thereover, and means on the slide bracket which engages and is secured to the support bracket for retaining the back frame in secured position on the base frame, the said strips having aligned apertures therethrough in the space between the one conical portion at one end and the two conical portions at the other end for screws and the like to secure the joined strips to the base frame, said retaining means on the slide bracket being a pivoted cam which is movable to lock the slide brackets onto the support brackets.

2. In an upholstered sofa as recited in claim 1, wherein a pair of aligned elongated runners are provided, one on the rear of the base frame and the other on the bottom of the back frame, and means secured to one runner which engages the other runner for retaining the two runners in aligned relation.

* * * * *